US008199085B2

(12) United States Patent
Kim et al.

(10) Patent No.: US 8,199,085 B2
(45) Date of Patent: Jun. 12, 2012

(54) DISPLAY APPARATUS

(75) Inventors: Sang-youn Kim, Daegu (KR); Cheal-gi Kim, Yongin-si (KR); Min-sung Choi, Cheonan-si (KR); Seung-ho Baek, Cheonan-si (KR); Hyoung-wook Kim, Busan (KR); Byoung-haw Park, Cheonan-si (KR); Ji-eun Jang, Asan-si (KR)

(73) Assignee: Samsung Electronics Co., Ltd, Suwon-Si, Gyeonggi-Do (KR)

( * ) Notice: Subject to any disclaimer, the term of this patent is extended or adjusted under 35 U.S.C. 154(b) by 1053 days.

(21) Appl. No.: 11/855,194

(22) Filed: Sep. 14, 2007

(65) Prior Publication Data

US 2008/0136767 A1 Jun. 12, 2008

(30) Foreign Application Priority Data

Dec. 12, 2006 (KR) ..... 10-2006-0126355

(51) Int. Cl.
*G09G 3/36* (2006.01)

(52) U.S. Cl. ..... 345/87

(58) Field of Classification Search ..... 345/87, 345/89

See application file for complete search history.

(56) References Cited

U.S. PATENT DOCUMENTS

| | | | | |
|---|---|---|---|---|
| 6,470,050 | B1 * | 10/2002 | Ohtani et al. | 375/240.16 |
| 2004/0196234 | A1 * | 10/2004 | Shiomi et al. | 345/89 |
| 2005/0231453 | A1 * | 10/2005 | Park et al. | 345/87 |
| 2006/0050038 | A1 * | 3/2006 | Cheon et al. | 345/89 |
| 2006/0219700 | A1 * | 10/2006 | Chen et al. | 219/497 |
| 2007/0075951 | A1 * | 4/2007 | Lin et al. | 345/89 |

* cited by examiner

*Primary Examiner* — Quan-Zhen Wang
*Assistant Examiner* — Tony Davis
(74) *Attorney, Agent, or Firm* — F. Chau & Associates, LLC

(57) ABSTRACT

A display apparatus and a driving method thereof, in which the display apparatus includes a temperature sensor detecting a temperature, a first memory, a timing controller that receives an (n−1)th image signal and an nth image signal of consecutive frames, corrects the nth image signal and outputs the nth image signal, wherein the timing controller generates a clock signal whose phase varies according to the detected temperature, writes the nth image signal in the first memory in synchronization with the clock signal, reads the (n−1)th image signal from the first memory, and compares the nth image signal and the (n−1)th image signal with each other to then correct the nth image signal based on the comparison result, a data driver that provides an image-data voltage corresponding to the corrected signal of the nth image signal, and a liquid crystal panel that displays an image corresponding to the image-data voltage.

19 Claims, 7 Drawing Sheets

DISPLAY APPARATUS

CROSS-REFERENCE TO RELATED APPLICATION

This application claims priority from Korean Patent Application No. 10-2006-0126355 filed on Dec. 12, 2006, in the Korean Intellectual Property Office, the disclosure of which is incorporated herein by reference in its entirety.

BACKGROUND OF THE INVENTION

1. Technical Field

The present disclosure relates to a display apparatus and a driving method thereof.

2. Discussion of Related Art

A liquid crystal display, which is an example of a display apparatus, uses memory for various purposes. For example, for the purpose of increasing the response speed of a liquid crystal display, a timing controller incorporated in the liquid crystal display may use a memory. That is, an image signal is written in the memory, an image signal is read from the memory, image signals of at least two frames are compared with each other, and the image signals are corrected based on the result of the comparison. As a result, the response speed of the liquid crystal display is increased.

In addition to increasing the response speed, the timing controller and the memory may exchange image signals in order to achieve other purposes. That is to say, when the timing controller performs a write operation, an image signal is written in the memory in synchronization with a clock signal. In this case, the timing controller may be set so as not to generate skew. In other words, the timing controller may be set so as to optimize a set-up time and a hold time of an image signal for the clock signal. In this case, when there is a temperature change, skew may be generated. In a case where skew is generated, the image signal may not be accurately written in the memory, so that the timing controller cannot process the image signal properly, thereby ultimately deteriorating the display quality of the liquid crystal display.

SUMMARY OF THE INVENTION

Exemplary embodiments of the present invention provide a display apparatus that can improve a display quality by preventing occurrence of skew, even when there is a temperature change.

Exemplary embodiments of the present invention also provide a method of driving a display apparatus that can improve a display quality by preventing occurrence of skew, even when there is a temperature change.

These and other exemplary embodiments of the present invention will be described in or may be apparent from the following description of the exemplary embodiments.

According to an exemplary embodiment of the present invention, there is provided a display apparatus including a temperature sensor detecting a temperature, a first memory, a timing controller that receives an (n−1)th image signal and an nth image signal of consecutive frames, corrects the nth image signal and outputs a corrected signal of the nth image signal, wherein the timing controller generates a clock signal whose phases vary according to the temperature, writes the nth image signal in the first memory in synchronization with the clock signal, reads the (n−1)th image signal from the first memory, and compares the nth image signal and the (n−1)th image signal with each other to correct the nth image signal based on the comparison result, a data driver that provides an image-data voltage corresponding to the corrected signal of the nth image signal, and a liquid crystal panel that displays an image corresponding to the image-data voltage.

According to an exemplary embodiment aspect of the present invention, there is provided a display apparatus including a temperature sensor detecting a temperature, a first memory, a timing controller that receives an (n−1)th image signal, an nth image signal and an (n+1)th image signal of consecutive frames, corrects the nth image signal and outputs a corrected signal of the nth image signal, wherein the timing controller generates a clock signal whose phases vary according to the temperature, writes the (n+1)th image signal in the first memory in synchronization with the clock signal, reads the nth image signal and the (n−1)th image signal from the first memory, and compares the (n+1)th image signal, the nth image signal and the (n−1)th image signal with one another to correct the nth image signal based on the comparison result, a data driver that provides an image-data voltage corresponding to the corrected signal of the nth image signal, and a liquid crystal panel that displays an image corresponding to the image-data voltage.

According to an exemplary embodiment of the present invention, there is provided a method of driving a display apparatus, the method including detecting a temperature, generating a clock signal whose phases vary according to the temperature, writing an (n+1)th image signal in a memory in synchronization with the clock signal, and reading an nth image signal and an (n−1)th image signal from the memory, comparing the (n+1)th image signal, the nth image signal and the (n−1)th image signal with one another, and correcting the nth image signal based on the comparison result, to then output a corrected signal of the nth image signal, providing an image-data voltage corresponding to the corrected signal of the nth image signal, and displaying an image corresponding to the image-data voltage.

BRIEF DESCRIPTION OF THE DRAWINGS

Exemplary embodiments of the present invention will be understood in more detail from the following descriptions taken in conjunction with the attached drawings, in which.

DETAILED DESCRIPTION OF EXEMPLARY EMBODIMENTS

Advantages and features of the present invention and methods of accomplishing the same may be understood more readily by reference to the following detailed description of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the invention to those of ordinary skill in the art, and the present invention will only be defined by the appended claims.

In the following description, a display apparatus will be explained with regard to a liquid crystal display by way of example but the present invention is not limited thereto. In addition, a display apparatus employing a memory for the purpose of increasing the response speed will be described by way of example. Because memories can be used for various purposes, however, the present invention is not limited to the case where the memory is used for increasing the response speed.

Figure 1:
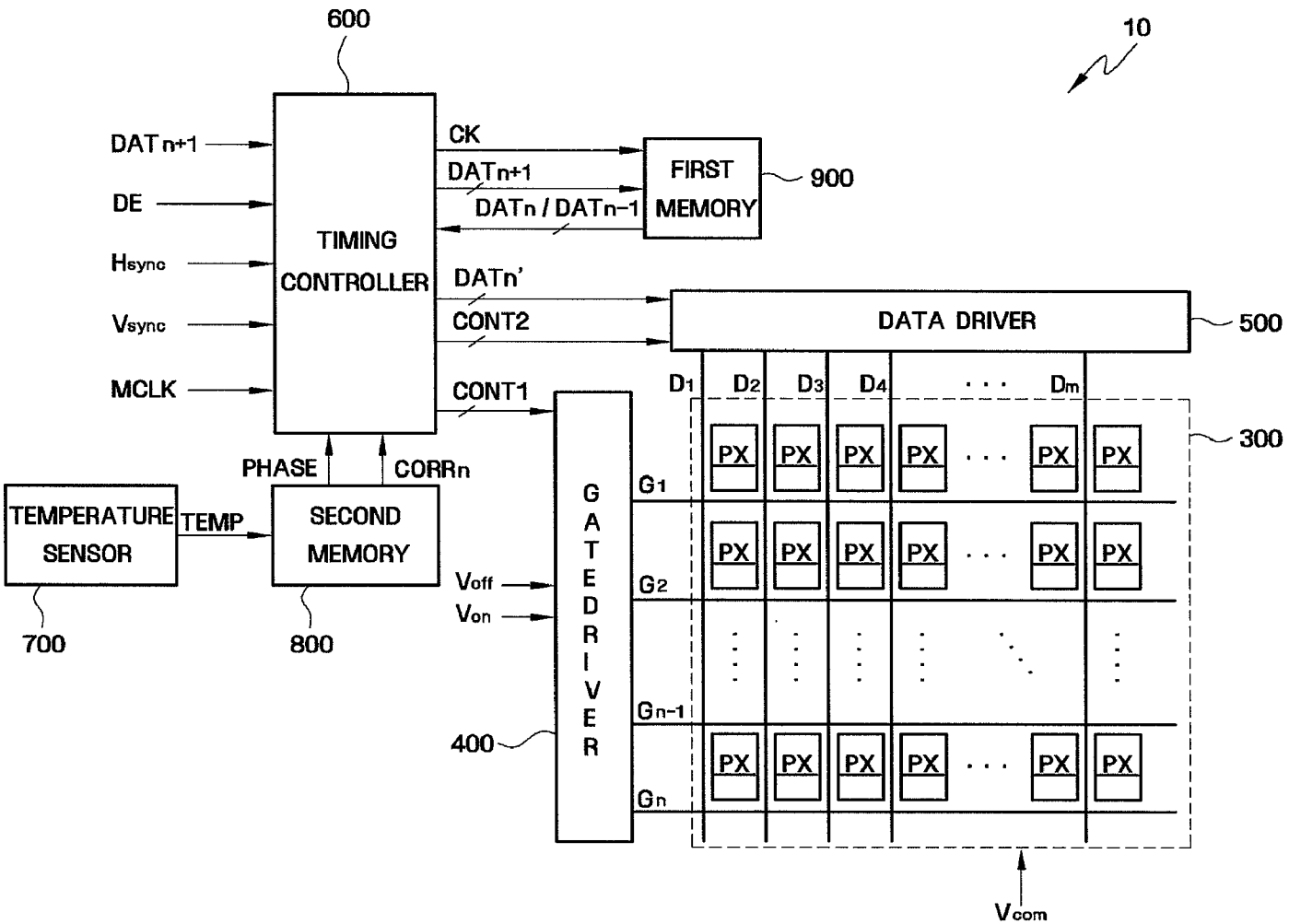
FIG. 1 is a block diagram of a liquid crystal display according to an exemplary embodiment of the present invention.
Figure 2:
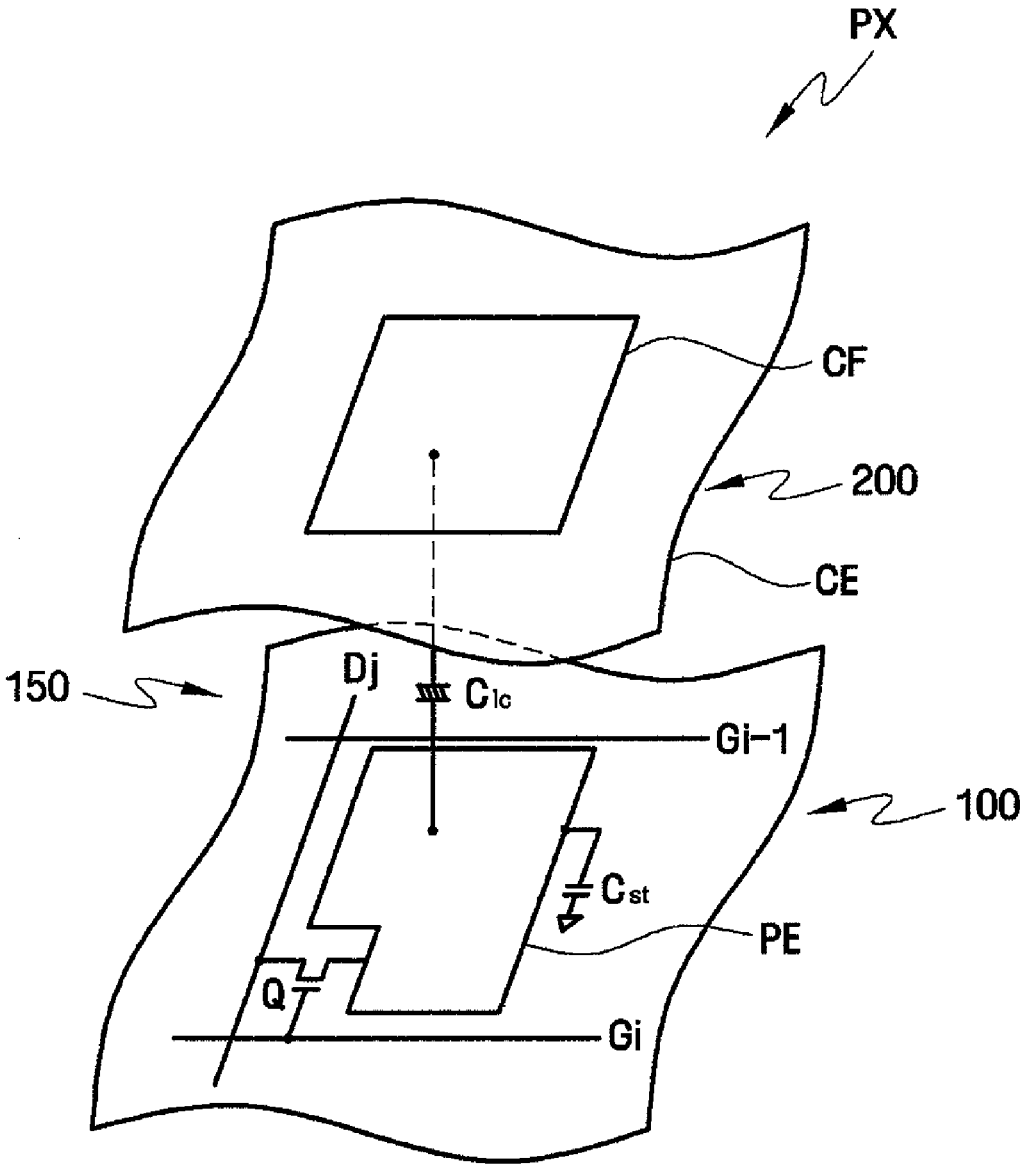
FIG. 2 is an equivalent circuit diagram of the pixel illustrated in FIG. 1.
Figure 3:
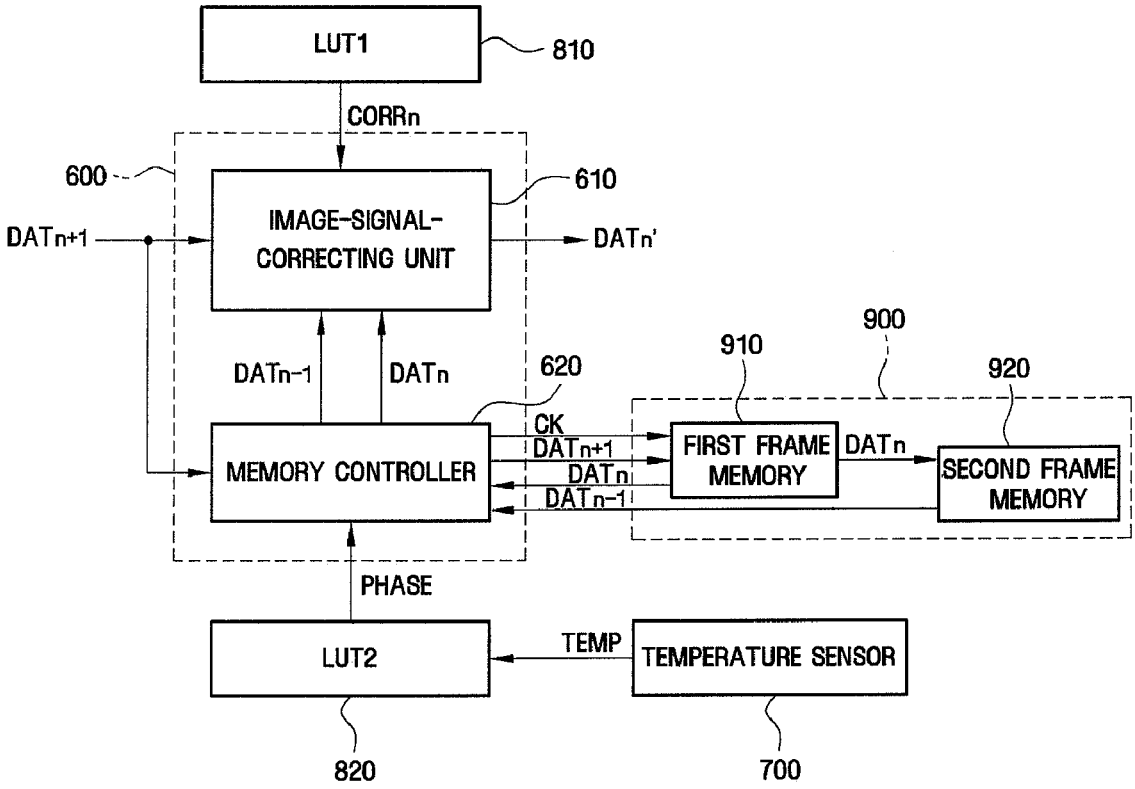
FIG. 3 is block diagram illustrating a timing controller and the first and second memories used in the display illustrated in FIG. 1.
Figure 4:
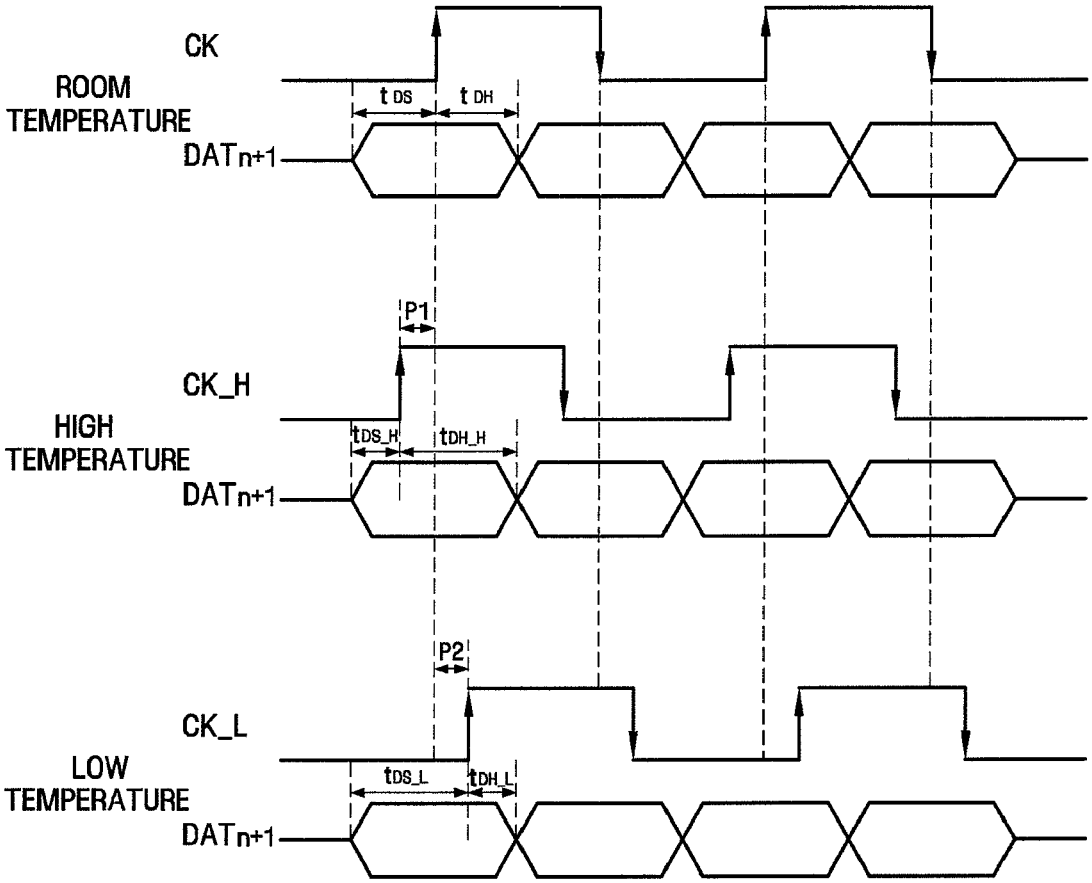
FIG. 4 is a signal diagram illustrating the operation of the memory controller used in the display illustrated in FIG. 3.
Figure 5:
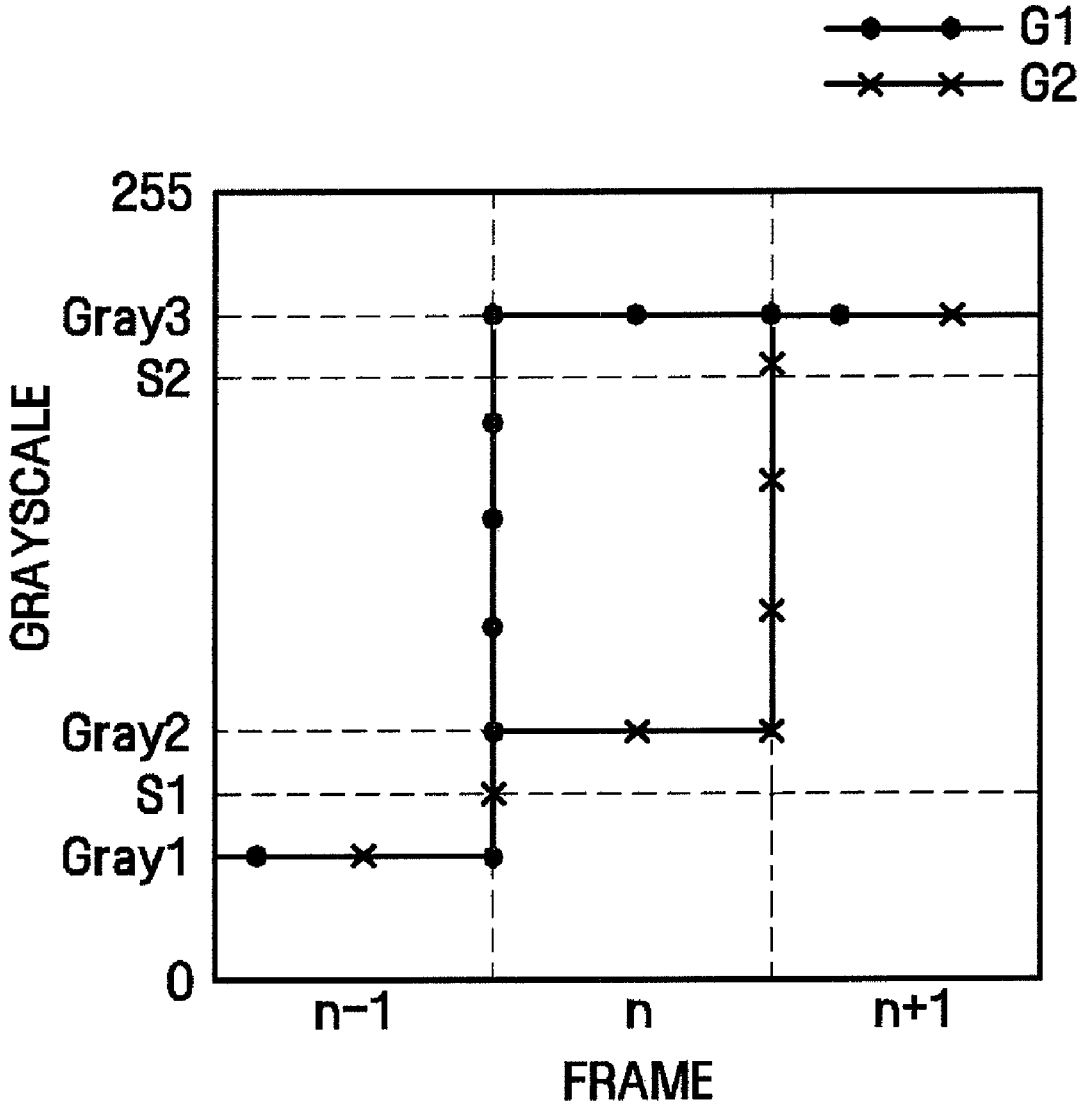
FIG. 5 is a graph for explaining the operation of an image-signal-correcting unit used in the timing controller illustrated in FIG. 3.

FIG. 1 is a block diagram of a liquid crystal display (10) according to an exemplary embodiment of the present invention, FIG. 2 is an equivalent circuit diagram of the pixel illustrated in FIG. 1, FIG. 3 is block diagram illustrating a timing controller and first and second memories used in the display illustrated in FIG. 1, FIG. 4 is a signal diagram for explaining the operation of a memory controller used in the display illustrated in FIG. 1, and FIG. 5 is a graph for explaining the operation of the image-signal-correcting unit used in the timing controller illustrated in FIG. 3.

Referring to FIG. 1, the liquid crystal display 10 according to an exemplary embodiment of the present invention includes a liquid crystal panel 300, a gate driver 400, a data driver 500, a timing controller 600, a temperature sensor 700, a first memory 900, and a second memory 800.

In the an electrical equivalent circuit, the liquid crystal panel 300 includes a plurality of display lines $G_1$ through $G_n$ and $D_1$ through $D_m$, and a plurality of pixels PX connected to the plurality of display lines $G_1$ through $G_n$ and $D_1$ through $D_m$ and arranged in a matrix. Referring to FIG. 2, the liquid crystal panel 300 includes a first substrate 100 and a second substrate 200 facing each other, and a liquid crystal 150 interposed between the first and second substrates 100 and 200.

The plurality of display lines $G_1$ through $G_n$ and $D_1$ through $D_m$ include a plurality of gate lines $G_1$ through $G_n$ for transmitting gate signals and a plurality of data lines $D_1$ through $D_m$ for transmitting data signals. The plurality of gate lines $G_1$ through $G_n$ extend in a row direction and are parallel or essentially parallel to one another, and the plurality of data lines $D_1$ through $D_m$ extend in a column direction and are parallel or essentially parallel to one another.

FIG. 2 is an equivalent circuit diagram of each of the pixels PX illustrated in FIG. 1.

Referring to FIG. 2, a pixel electrode PE is formed on the first substrate 100, and a color filter CF is formed on a portion of a common electrode CE on the second substrate 200 so as to face the pixel electrode PE formed on the first substrate 100. A pixel PX which is connected to, for example, an i-th gate line $G_i$ (i=1 to n) and a j-th data line $D_j$ (j=1 to m), includes a switching device Q that is connected to the i-th gate line $G_i$ and the j-th data line $D_j$, a liquid crystal capacitor $C_{lc}$ that is connected to the switching device Q, and a storage capacitor $C_{st}$.

The gate driver 400 shown in FIG. 1 is provided with a gate control signal CONT1 from the timing controller 600, and provides gate signals to the gate lines $G_1$ through $G_n$. In this exemplary embodiment, the gate signals comprise a combination of gate ON voltages Von and gate OFF voltages Voff supplied from a gate on/off voltage generator (not shown). The gate control signal CONT1 controls the operation of the gate driver 400 and includes a vertical synchronization start signal to instruct a start of an output of a gate-ON voltage, a gate clock signal to control an output timing of the gate-ON voltage, and a gate-ON enable signal to limit a width of a gate-ON pulse, that is, the gate-ON voltage interval.

The data driver 500 is provided with a data control signal CONT2 from the timing controller 600 and provides image-data voltage to the data lines $D_1$ through $D_m$.

The image-data voltages are gray scale voltages corresponding to corrected n−1 image signals supplied from a gray scale voltage generator (not shown). The data control signal CONT2 controls the operation of the data driver 500 and includes a horizontal synchronization start signal to instruct a start of an output of a data-ON voltage, a gate clock signal to control an output timing of the data-ON voltage, an output enable signal OE, and other control signals.

The gate driver 400 or the data driver 500 may be directly mounted on the liquid crystal panel 300 in the form of at least one IC chip on the liquid crystal panel 300. Alternatively, the gate driver 400 or the data driver 500 may be attached to the liquid crystal panel 300 in the form of a tape carrier package ("TCP") on a flexible printed circuit ("FPC") film (not shown) in the liquid crystal panel 300. Alternatively, the gate driver 400 or the data driver 500 together with the plurality of display lines $G_1$ through $G_n$ and $D_1$ through $D_m$ and switching devices Q may be integrally formed with the liquid crystal panel 300.

The timing controller 600 applies n image signals and input control signals to control a display thereof from an external graphics controller (not shown). Examples of the input control signals include a vertical synchronizing signal Vsync, a horizontal synchronizing signal Hsync, a main clock signal MCLK, and a data enable signal DE.

The timing controller 600 generates the gate control signal CONT1 and the data control signal CONT2 based on the input control signals and transmits the gate control signal CONT1 and the data control signal CONT2 to the gate driver 400 and the data driver 500, respectively.

In addition, the timing controller 600 compares an (n−1)th image signal DATn−1, an nth image signal DATn, and an (n+1)th image signal DATn+1 of consecutive frames with one another, corrects the nth image signal DATn using an nth correction signal CORRn based on the comparison result from the second memory 800 and provides a corrected signal DATn' of the nth image signal to the data driver 500. In other words, for comparison of the image signals DATn−1, DATn and DATn+1 of the three consecutive frames, the (n−1)th image signal DATn−1 and the nth image signal DATn, which are pre-stored in the first memory 900, are read from the first memory 900, and the (n+1)th image signal DATn+1 is written in the first memory 900.

The timing controller 600 writes the (n+1)th image signal DATn+1 in the first memory 900 in synchronization with a clock signal CK without skew even when there is a change in the temperature. In other words, when writing the (n+1)th image signal DATn+1 to the first memory 900, a set-up time and a hold time are optimized and maintained irrespective of the change in temperature, which will now be briefly described. That is, the temperature sensor 700 detects ambient temperatures to provide a temperature signal TEMP to the second memory 800. Then, the second memory 800 provides phase control signals PHASE corresponding to the ambient temperatures to the timing controller 600. The timing controller 600 receives the phase control signals PHASE and adjusts the phase of the clock signal CK, such that the set-up time and the hold time are maintained at constant levels.

The operation of the timing controller 600 will be described in greater detail with reference to FIGS. 3 and 4.

Referring to FIG. 3, the timing controller 600 includes an image-signal-correcting unit 610 and a memory controller 620. The second memory 800 shown in FIG. 1 is an EEPROM (Electrically Erasable and Programmable Read-Only Memory), and may include a first look-up table (LUT1) 810 and a second LUT (LUT2) 820. For convenience of explanation, FIG. 3 shows that the LUT1 810 and the LUT2 820 are separated from each other, but they are not necessarily physically separated from each other and are both part of the second memory 800. In addition, the first memory 900 will be described below with regard to a DDR (Double Data Rate) memory in which data is read or written at rising and falling edges of the clock signal CK. An interface (not shown) is provided between the temperature sensor 700 and the LUT 1 810, or between the LUT2 820 and timing controller 600 may be an Inter Integrated Circuit ('$I^2C$'), interface which is a kind of digital serial interface.

The temperature sensor 700 detects ambient temperatures to provide a temperature signal TEMP to the LUT2 820. The LUT2 820 receives the temperature signal TEMP and provides a phase control signal PHASE to the memory controller 620. In this exemplary embodiment, the phase control signal PHASE may be a signal that adjusts the magnitude of a phase shift of the clock signal CK corresponding to the temperature.

Referring to FIG. 4, the memory controller 620 generates the clock signal CK so as not to generate skew at room temperature, and outputs the clock signal CK and the (n+1)th image signal DATn+1. For example, a set-up time $t_{DS}$ and a hold time $t_{DH}$ may be 50% of an output time of the (n+1)th image signal DATn+1. If there is a change in the temperature, however, skew may be generated. As shown in FIG. 4, a set-up time $t_{DS}$_H may be shortened and a hold time $t_{DH}$_H may be lengthened at a high temperature, for example. Similarly, at a low temperature, a set-up time $t_{DS}$_L may be shortened and a hold time $t_{DH}$_L may be lengthened. As such, when there is a temperature change, skew may be generated. When skew occurs, the (n+1)th image signal DATn+1 may not be accurately stored in the first memory 900, thereby deteriorating the display quality. According to exemplary embodiments of the present invention, the phase of the clock signal CK is shifted at high or low temperatures, thereby suppressing the occurrence of skew.

In other words, when the ambient temperature is high, the LUT2 820 provides a phase control signal PHASE corresponding to the high temperature to output a phase-increased clock signal after increasing the phase of a clock signal CK-H output at high temperature by P1, as shown in FIG. 4. If the phase of the clock signal CK-H output at a high temperature is increased by P1, the phase of the clock signal CK-H becomes the same as that of the clock signal CK at room temperature and the set-up time $t_{DS}$ and the hold time $t_{DH}$ are also maintained at the same levels as those at room temperature. In addition, when the ambient temperature is low, the LUT2 820 provides a phase control signal PHASE corresponding to the low temperature to output a phase-decreased clock signal after decreasing the phase of a clock signal CK-L output at low temperature by P2, as shown in FIG. 4. If the phase of the clock signal CK-L output at a low temperature is decreased by P2, the phase of the clock signal CK-L becomes the same as that of the clock signal CK at room temperature and the set-up time $t_{DS}$ and the hold time $t_{DH}$ are also maintained at the same levels as those at room temperature. Accordingly, the occurrence of skew can be suppressed irrespective of changes in the ambient temperature.

The operations of the temperature sensor 700, the LUT2 820 and the memory controller 620 are summarized below in Table 1.

TABLE 1

Operations of the Temperature Sensor

| Temperature | Phase | Phase shift in CK |
|---|---|---|
| Room temperature | 000 | No shift |
| Room temperature-Room temperature + 10 | 001 | P × (1/8) |
| Room temperature + 10-Room temperature + 20 | 010 | P × (2/8) |
| Room temperature + 20-Room temperature + 30 | 011 | P × (3/8) |
| Room temperature + 30-Room temperature + 40 | 100 | P × (4/8) |
| Room temperature + 40-Room temperature + 50 | 101 | P × (5/8) |
| Room temperature-Room temperature − 10 | 110 | P × (6/8) |
| Room temperature − 10-Room temperature − 20 | 111 | P × (7/8) |

Referring to Table 1, when the temperature detected by the temperature sensor 700 is room temperature, that is, normal, the LUT2 820 provides 000 as a phase control signal PHASE to the memory controller 620, while the memory controller 620 outputs the phase of the clock signal CK as it is without being changed.

When the detected temperature is room temperature+30 ~room temperature+40, the LUT2 820 provides 100 as the phase control signal PHASE to the memory controller 620. The memory controller 620 increases the phase of clock signal CK by P(4/8). Here, P indicates a predetermined time. Table 1 illustrates only exemplary operations of the temperature sensor 700, the LUT2 820 and the memory controller 620, and the operations thereof are not limited to the illustrated example.

Referring back to FIG. 3, the first memory 900 includes a first frame memory 910 and a second frame memory 920. The (n+1)th image signal DATn+1 is written on the first frame memory 910 in synchronization with the clock signal CK whose set-up time and hold time are maintained at constant levels, as described above. The first frame memory 910 provides the nth image signal DATn to the memory controller 620 and the second frame memory 920. The second frame memory 920 provides the (n−1)th image signal DATn−1 to the memory controller 620 and stores the nth image signal DATn.

The image-signal-correcting unit 610 receives the (n−1)th image signal DATn−1, the nth image signal DATn, and the (n+1)th image signal DATn+1 for comparison, receives the nth correction signal CORRn based on the comparison result from the LUT1 810, corrects the nth image signal DATn, and outputs a corrected image DATn' of the nth image signal. In order to increase the response speed of an LCD, such as the display 10 of FIG. 1, the image-signal-correcting unit 610 corrects the nth image signal DATn. In this exemplary embodiment, the nth correction signal CORRn may be the same as the corrected signal DATn' of the nth image signal. The operation of the image-signal-correcting unit 610 will be described below in detail with reference to FIG. 5.

Referring to FIG. 5, the x-axis indicates frames, and the y axis indicates grayscale values. A first plot G1 represents grayscale values of an image signal input to the image-signal-correcting unit (see 610 of FIG. 3), and a second graph G2 represents grayscale values of an image signal output from the image-signal-correcting unit (see 610 of FIG. 3). Here, it is assumed that these are 256 grayscale values by way of example.

TABLE 2

| | | | |
|---|---|---|---|
| Before correction | DATn − 1 < S1 | S2 < DATn | S2 < DATn + 1 |
| After correction | | S1 < DATn' < S2 | |

First, the operation of the image-signal-correcting unit 610 of FIG. 3 will be described with reference to the above Table 2. Before correction, if a grayscale value of the (n−1)th image signal DATn−1 of the (n−1)th frame is smaller than a first reference value S1, a grayscale value of the nth image signal DATn of the nth frame is greater than a second reference value S2, and a grayscale value of the (n+1)th image signal DATn+1 of the (n+1)th frame is greater than the second reference value S2, the image-signal-correcting unit 610 of FIG. 3 corrects the nth image signal DATn and outputs a corrected signal DATn' of the nth image signal, which is greater than the first reference value S1 and smaller than the second reference value S2.

Referring to the first plot G1 of FIG. 5, a first grayscale value Gray1 in the (n−1)th frame is smaller than the first reference value S1, and a third grayscale value Gray3 is greater than the second reference value S2 in the nth and (n+1)th frames.

Accordingly, the image-signal-correcting unit 610 of FIG. 3 outputs the corrected signal DATn' of the nth image signal of the second grayscale value Gray2, which is greater than the first reference value S1, and smaller than the second reference value S2, as represented by the second plot G2.

If the corrected signal DATn' of the nth image signal, having the second grayscale value Gray2 and being between the first reference value S1 and the second reference value S2, is applied to a pixel, shown at PX in FIG. 2, the liquid crystal 150 of FIG. 2 is pre-tilted. Thus, even if the (n+1)th image signal DATn+1 having the third grayscale value Gray3 of a great difference from the first grayscale value Gray1 is applied to the pixel PX of FIG. 2 in the (n+1)th frame, the liquid crystal 150 can be rapidly pre-tilted because the corrected signal DATn' of the nth image signal, having the second grayscale value Gray2, has already been applied thereto in the nth frame. Thus, the response speed of the liquid crystal 150 can be enhanced, thereby improving the display quality of the LCD 10 of FIG. 1. Table 2 illustrates only an exemplary operation of the image-signal-correcting unit 610, and the image-signal-correcting unit 610 may operate in many alternative ways to increase the response speed of the liquid crystal.

As described above, increasing the response speed of the LCD 10 of FIG. 1 can be performed through comparison of the (n−1)th image signal DATn−1, the nth image signal DATn, and the (n+1)th image signal DATn+1 of three consecutive frames. For this, the image signals should be correctly stored in the first memory 900. Since the LCD 10 of FIG. 1 according to exemplary embodiments of the present invention maintains constant levels of a set-up time and a hold time irrespective of temperature without skew, the image signals can be correctly stored in the first memory 900, and correction for increasing the response speed can be properly achieved accordingly, thereby improving the display quality of the LCD 10. The present invention is not limited to the illustrated exemplary embodiment in which the first memory 900 is used for the purpose of increasing the response speed, however, and encompasses a case in which the timing controller 600 controls data to be written in a memory in order to achieve various other purposes.

Figure 6:
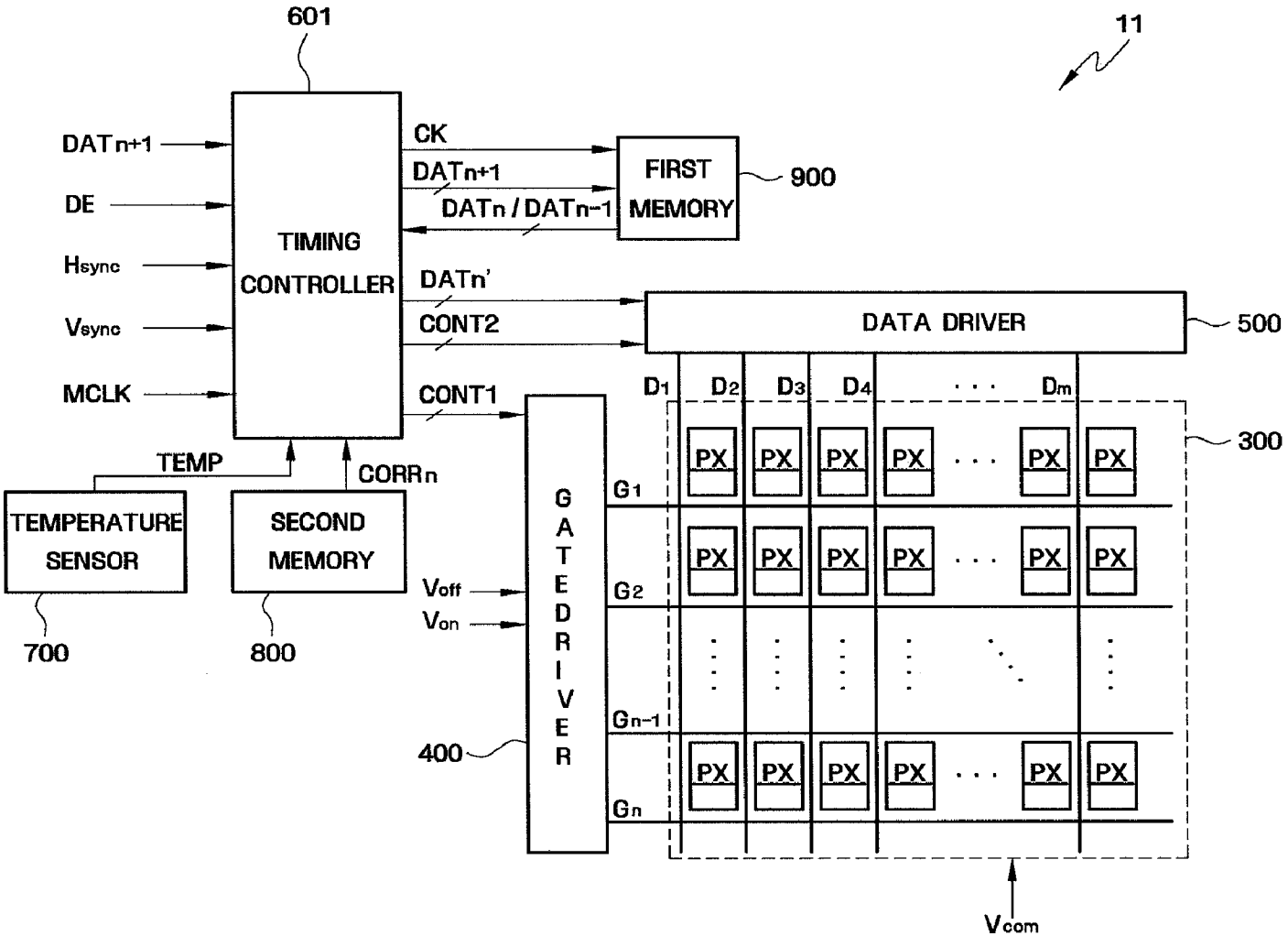
FIG. 6 is a block diagram of a liquid crystal display according to an exemplary embodiment of the present invention.

A liquid crystal display according to an exemplary embodiment of the present invention will now be described with reference to FIG. 6. FIG. 6 is a block diagram of a liquid crystal display according to an exemplary embodiment of the present invention. For the convenience of explanation, the same reference numerals denote the same elements in FIG. 1, and thus further descriptions of the same elements have been omitted.

Referring to FIG. 6, unlike the previous embodiment, a temperature sensor 700 provides a temperature signal TEMP to a timing controller 601, and a second memory 800 provides only an nth correction signal CORRn to the timing controller 601.

Figure 7:
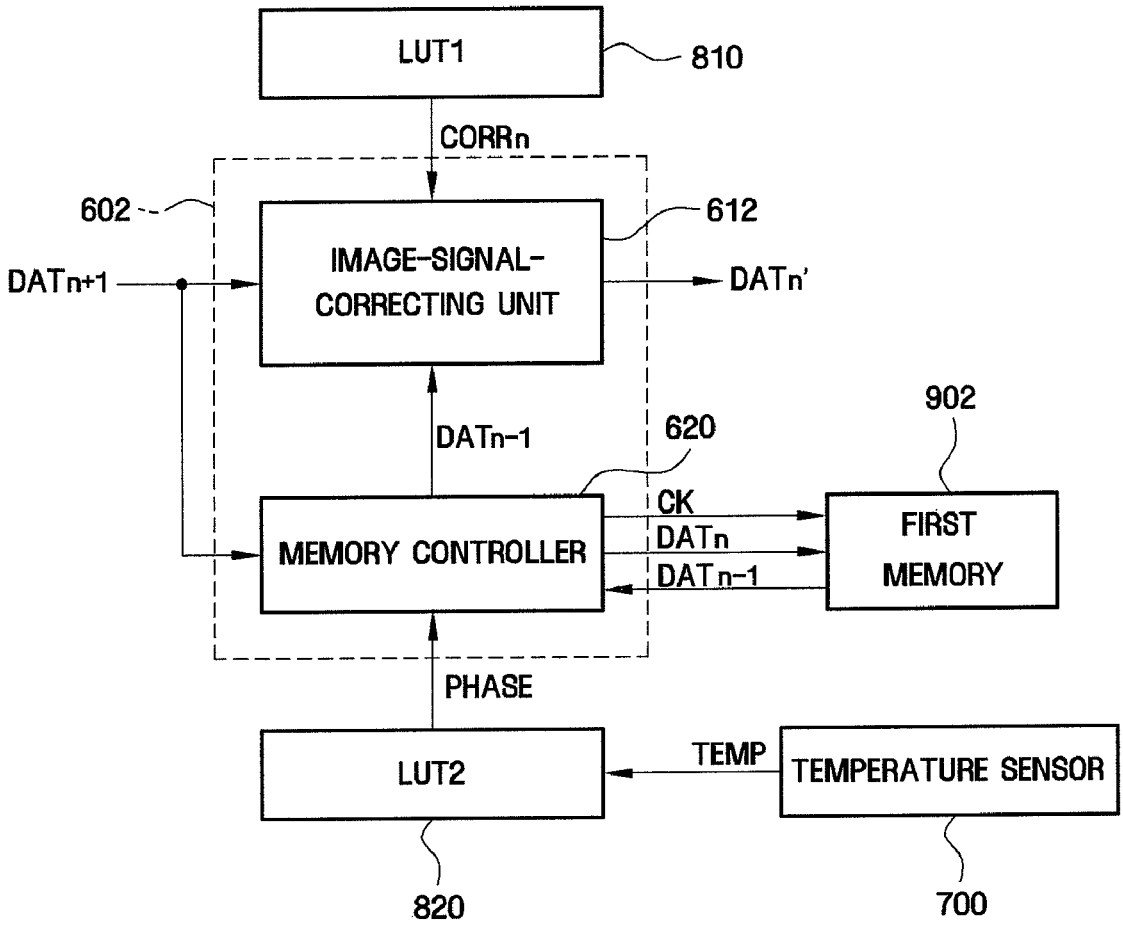
FIG. 7 is block diagram illustrating a timing controller of a liquid crystal display according to an exemplary embodiment of the present invention.

In other words, a second LUT (LUT2) 820 of FIG. 7 is stored within the timing controller 601, and the temperature signal TEMP in a digital form from the temperature sensor 700 is applied to the LUT2 820 so that a phase of a clock signal CK is shifted.

A liquid crystal display according to an exemplary embodiment of the present invention will now be described with reference to FIG. 7. FIG. 7 is block diagram illustrating a timing controller of a liquid crystal display according to an exemplary embodiment of the present invention. For explanatory convenience, the same reference numerals denote the same elements as in FIG. 3 and, thus, further descriptions of the same elements have been omitted.

Referring to FIG. 7, unlike the previous embodiment, an image-signal-correcting unit 612 compares the (n−1)th image signal DATn−1 and the nth image signal DATn of two consecutive frames with each other, corrects the nth image signal DATn using the nth correction signal CORRn based on the comparison result, and outputs the corrected signal DATn' of the nth image signal. Thus, the first memory 900 stored only the nth image signal DATn and provides the (n−1)th image signal DATn−1 to the memory controller 620.

For example, when a grayscale value of the nth image signal DATn is greater than that of the (n−1)th image signal DATn−1, the image-signal-correcting unit 612 outputs the corrected signal DATn' of the nth image signal, having a grayscale value greater than that of the nth image signal DATn. When the grayscale value of the nth image signal DATn is smaller than that of the (n−1)th image signal DATn−1, the image-signal-correcting unit 612 outputs the corrected signal DATn' of the nth image signal, having a grayscale value smaller than that of the nth image signal DATn. Through this correcting process, the response speed of the liquid crystal 150 of FIG. 2 is increased. In this exemplary embodiment, the nth correction signal CORRn may be the same as the corrected signal DATn' of the nth image signal.

In the exemplary embodiment, a first memory 902 may be an SDRAM (Synchronous Dynamic Random Access Memory). In the case where the first memory 902 is an SDRAM, unlike DDR memory, data can be written or read only at rising edges of the clock signal CK. In other words, on the basis of the rising edge of the clock signal CK, the nth image signal DATn can maintain a set-up time and a hold time at constant levels irrespective of temperature, and no skew is generated.

The liquid crystal display of exemplary embodiments of the present invention provides at least one of the following advantages.

First, no skew is generated when an image signal from a timing controller is written in a memory irrespective of temperature.

Second, since skew is eliminated, writing and reading of an image signal can be performed correctly, thereby accurately correcting the image signal and ultimately enhancing the response speed of the liquid crystal display.

Third, since the image signal, which is for the purpose of enhancing the response speed of the liquid crystal display, is properly corrected, the display quality of the liquid crystal display can be enhanced.

While the present invention has been particularly shown and described with reference to exemplary embodiments thereof, it will be understood by those of ordinary skill in the art that various changes may be made in the form and details without departing from the spirit and scope of the present invention as defined by the following claims. It is therefore desired that the exemplary embodiments be considered in all respects as illustrative and not restrictive, reference being made to the appended claims rather than the foregoing description to indicate the scope of the invention.

What is claimed is:

1. A display apparatus comprising:

a temperature sensor detecting a temperature;

a first memory;

a timing controller that receives an (n−1)th image signal and an nth image signal of consecutive frames, corrects the nth image signal and outputs a corrected signal of the nth image signal, wherein the timing controller generates a clock signal whose phase increases or decreases according to the detected temperature without changing a frequency of the clock signal, writes the nth image signal in the first memory in synchronization with the clock signal, reads the (n−1)th image signal from the first memory, and compares the nth image signal and the (n−1)th image signal with each other to correct the nth image signal based on the comparison result;

a data driver that provides an image-data voltage corresponding to the corrected signal of the nth image signal; and a liquid crystal panel that displays an image corresponding to the image-data voltage.

2. The display apparatus of claim 1, wherein the timing controller maintains a set-up time and a hold time of the nth image signal for the clock signal irrespective of the detected temperature.

3. The display apparatus of claim 2, wherein the timing controller increases a phase of the clock signal when the temperature is lowered from a predetermined temperature.

4. The display apparatus of claim 2, wherein the timing controller decreases a phase of the clock signal when the temperature is raised from a predetermined temperature.

5. The display apparatus of claim 1, further comprising a second memory including a first look-up table (LUT) that receives the detected temperature and provides a phase control signal corresponding to the detected temperature to the timing controller, and a second LUT that provides the nth correction signal for correcting the nth image signal fed to the timing controller.

6. The display apparatus of claim 5, wherein the timing controller includes a memory controller that provides the phase control signal and increases or decreases the phase of the clock signal, and an image-signal-correcting unit that provides the nth correction signal and corrects the nth image signal.

7. The display apparatus of claim 1, wherein the first memory is a Synchronous Dynamic Random Access Memory.

8. A display apparatus comprising:

a temperature sensor detecting a temperature;

a first memory;

a timing controller that receives an (n−1)th image signal, an nth image signal, and an (n+1)th image signal of consecutive frames, corrects the nth image signal and outputs a corrected signal of the nth image signal, wherein the timing controller generates a clock signal whose phase increases or decreases according to the detected temperature without changing a frequency of the clock signal, writes the (n+1)th image signal in the first memory in synchronization with the clock signal, reads the nth image signal and the (n−1)th image signal from the first memory, and compares the (n+1)th image signal, the nth image signal and the (n−1)th image signal with one another, to correct the nth image signal based on the comparison result;

a data driver that provides an image-data voltage corresponding to the corrected signal of the nth image signal; and a liquid crystal panel that displays an image corresponding to the image-data voltage.

9. The display apparatus of claim 8, wherein the timing controller maintains a set-up time and a hold time of the (n+1)th image signal for the clock signal irrespective of the detected temperature.

10. The display apparatus of claim 9, wherein the timing controller increases a phase of the clock signal when the temperature is lowered from a predetermined temperature.

11. The display apparatus of claim 9, wherein the timing controller decreases a phase of the clock signal when the temperature is raised from a predetermined temperature.

12. The display apparatus of claim 8, further comprising a second memory including a first look-up table that receives the detected temperature and provides a phase control signal corresponding to the detected temperature to the timing controller, and a second LUT that provides the nth correction signal for correcting the nth image signal fed to the timing controller.

13. The display apparatus of claim 12, wherein the timing controller includes a memory controller that provides the phase control signal and increases or decreases the phase of the clock signal, and an image-signal-correcting unit that provides the nth correction signal and corrects the nth image signal.

14. The display apparatus of claim 8, wherein the first memory includes a first frame memory that stores the (n+1)th image signal and outputs the nth image signal, and a second frame memory that stores the nth image signal and outputs the (n−1)th image signal.

15. The display apparatus of claim 14, wherein the first memory is a Double Data Rate memory.

16. A method of driving a display apparatus, the method comprising:

detecting a temperature;

generating a clock signal whose phase shifts increases or decreases according to the detected temperature without changing a frequency of the clock signal;

writing an (n+1)th image signal in a memory in synchronization with the clock signal, and reading an nth image signal and an (n−1)th image signal from the memory;

comparing the (n+1)th image signal, the nth image signal and the (n−1)th image signal with one another, and correcting the nth image signal based on the comparison result, to output a corrected signal of the nth image signal;

providing an image-data voltage corresponding to the corrected signal of the nth image signal; and displaying an image corresponding to the image-data voltage.

17. The method of claim 16, wherein the step of generating the clock signal comprises maintaining a set-up time and a hold time of the nth image signal for the clock signal irrespective of the detected temperature.

18. The method of claim 17, wherein the step of generating the clock signal comprises increasing the phase of the clock signal when the temperature is lowered from a predetermined temperature.

19. The method of claim 18, wherein the generating of the clock signal comprises decreasing a phase of the clock signal when the temperature is raised from a predetermined temperature.

* * * * *